United States Patent [19]

Whitlock

[11] 4,256,943

[45] Mar. 17, 1981

[54] TOGGLE SWITCH ACTUATING APPARATUS

[76] Inventor: Richard D. Whitlock, 306 Bicentennial Ct., Powell, Wyo. 82435

[21] Appl. No.: 14,372

[22] Filed: Feb. 23, 1979

[51] Int. Cl.[3] ..... H01H 3/04

[52] U.S. Cl. ..... 200/331; 74/544

[58] Field of Search ..... 200/331, 332; 74/544

[56] References Cited

U.S. PATENT DOCUMENTS

| | | | |
|---|---|---|---|
| 1,721,222 | 7/1929 | Kaminsky | 200/331 X |
| 2,726,303 | 12/1955 | Berndsen | 200/331 |
| 3,121,778 | 2/1964 | Sander et al. | 200/331 |
| 3,142,744 | 7/1964 | Keck | 200/331 |
| 3,581,037 | 5/1971 | Schiffelbein | 200/331 |
| 3,590,648 | 7/1971 | Gorman | 200/331 X |
| 3,722,319 | 3/1973 | Reznik et al. | 200/331 X |

*Primary Examiner*—Stephen Marcus

*Attorney, Agent, or Firm*—Arthur L. Urban

[57] ABSTRACT

Apparatus for actuating an electrical toggle switch including a rigid rod member, carriage means disposed along the length of the rod member supporting the rod member for movement with respect thereto, fastening means associated with the carriage means for securing the carriage means to a fixed surface adjacent to an electrical toggle switch, connecting means on the end of the rod member adjacent to the switch, the connecting means including a rod-engaging portion, a toggle-engaging portion and a pivotable section connecting the rod-engaging portion with the toggle-engaging portion, and an enlarged portion on the free end of the rod member remote from the toggle switch.

6 Claims, 4 Drawing Figures

TOGGLE SWITCH ACTUATING APPARATUS

This invention relates to a novel apparatus for switches and more particularly relates to a new apparatus for actuating toggle switches.

Switches ordinarily are used to control the flow of electrical current to a variety of devices which operate by electricity. Commonly, switches are used to activate lamps, motors, appliances and the like. In some cases, the switches are located in the same housing as the lamp, etc. as an integral part of the apparatus.

In other cases, the switches are a part of the wiring of the building and operate the electrical devices from a remote location. An example of the latter arrangement is the wiring of lighting fixtures are controlled by wall switches mounted adjacent to the entrances of the rooms in which the fixtures are located.

In homes, such wall switches ordinarily are located at a standard height of about four feet so they can be used conveniently by the occupants of the home. Although this is the objective, often the actual location of the switches leaves much to be desired. For example, the placement of furniture or appliances may obstruct use of the switches. In such situations, it either is necessary to place the furniture in a less desirable position to one side of the switch or it is necessary to space the furniture from the wall to allow room to reach behind the furniture to operate the switch.

Even when the switch is not obstructed by furniture, a problem still is presented if there are small children in the family. Frequently, children attain an age at which they are mature enough that their parents permit them to move through the home independently. For example, they may go to their bedrooms, to the bathroom or to other rooms without supervision. Although the children may be mature enough to operate the lights, they still may be too short in stature to reach the switches.

In these circumstances, a child may have to get a step stool and place it under the switch so he can reach it. This can be frustrating to the child and also to the parents if the child should bump the step stool against furniture or walls in moving the stool.

The alternatives also are not desirable. The child can ask a parent or older sibling to operate the switch for him. This results in frequent interruptions of the parent's or sibling's activities and may cause them to become irritated with the child and thereby develop into harsh words or arguments. Another alternative is to allow the lights to remain burning for long periods even when not in use with a significant waste of energy and increased utility costs.

The present invention provides a novel apparatus for actuating toggle switches which enables the switches to be operated from a point spaced therefrom. The toggle switch actuating apparatus of the invention enables furniture and appliances to be placed in desired locations without restrictions due to the position of switches. Also, the switch actuating apparatus enables small children to operate switches without assistance from older persons.

The switch actuating apparatus of the invention is convenient to use. The apparatus can be mounted for use easily with a minimum of instruction and without special skills or tools. The toggle switch actuating apparatus of the present invention is simple in design and inexpensive to manufacture. The apparatus can be fabricated from commercially available materials and components using conventionally employed techniques.

Other benefits and advantages of the novel switch actuating apparatus of the present invention will be apparent from the following description and the accompanying drawings in which.

Figure 2:
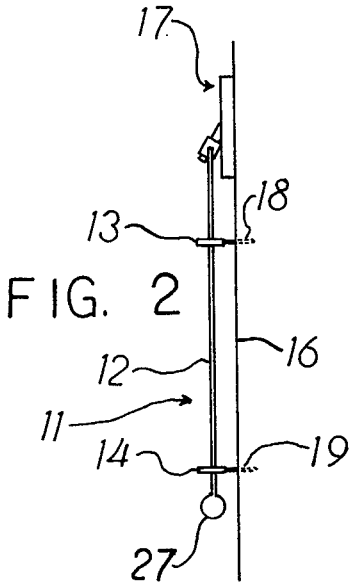
FIG. 2 is a side view of the switch actuating apparatus shown in FIG. 1.

As shown in the drawings, one form of the novel switch actuating apparatus 11 of the invention includes a rigid rod member 12 and carriage means disposed along the length of the rod member. The carriage means advantageously includes a plurality of rod-encircling members shown as eyes 13 and 14 which support the rod member 12 for movement with respect thereto, that is, the rod member 12 is slidably disposed within eyes 13 and 14.

Fastening means are associated with the carriage means for securing the carriage means to a fixed surface such as wall 16, which is adjacent to an electrical toggle switch 17. As shown, the fastening means advantageously are threaded extensions 18 and 19 of eyes 13 and 14, respectively. Screw eyes of this type are available in hardware departments and stores.

Figure 1:
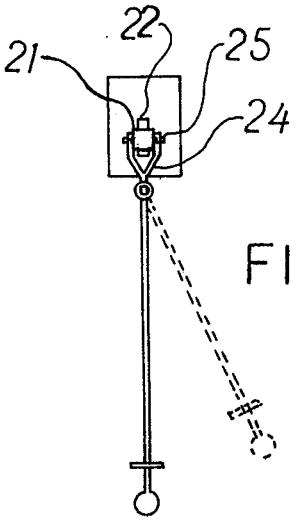
FIG. 1 is a front view of one form of the novel switch actuating apparatus of the invention mounted for use with a toggle switch.
Figure 3:
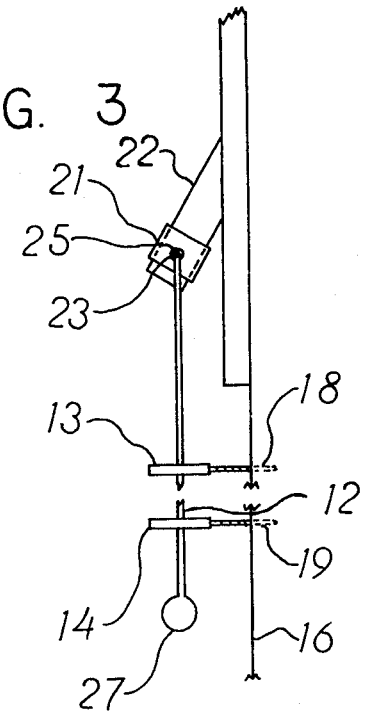
FIG. 3 is an enlarged fragmentary side view of the connection between the switch actuating apparatus and a toggle switch as shown in FIGS. 1 and 2.

Connecting means are disposed on the end of the rod member 12 which is adjacent to switch 17. The connecting means include a rod-engaging portion, a toggle-engaging portion and a pivotable section connecting the rod-engaging portion with the toggle-engaging portion. As shown in FIGS. 1–3, a sleeve 21 is slipped over the end of toggle 22 of switch 17. Sleeve 21 is pivotally connected to openings 23 in forked upper end 24 of rod member 12 with pins 25 which extend from either side of the sleeve.

The lower free end of rod member 12 which is remote from switch 17 has an enlarged portion. The enlarged portion as shown in FIGS. 1–3 of the drawings is a spherical member 27. The enlarged portion also may take other forms such as ring member 30 shown in FIG. 4.

Figure 4:
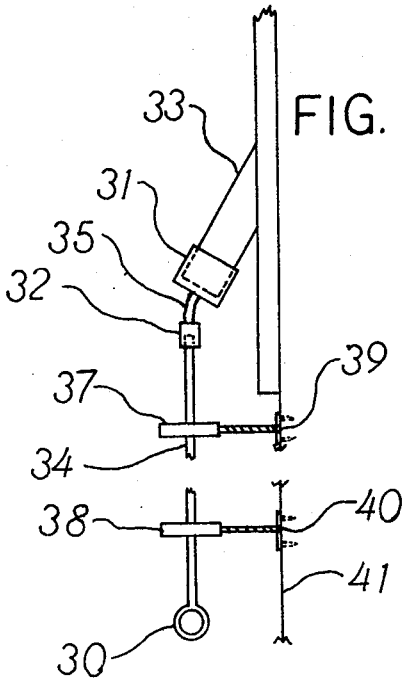
FIG. 4 is an enlarged fragmentary side view of the connection between another form of the switch actuating apparatus of the invention with a toggle switch.

FIG. 4 shows another form of the toggle switch actuating apparatus of the invention. As shown, the toggle-engaging portion and the rod-engaging portion are caps 31 and 32, respectively. Advantageously, these caps are molded of a resilient plastic material and are sized to frictionally engage the end of a toggle 33 and the upper end of a rod member 34. The pivotable section may be a hinge portion 35 of reduced cross section which is molded integrally with the caps 31 and 32 to form a single unit. The carriage means shown includes rod-encircling eyes 37 and 38 having bracket extensions 39 and 40 which are suitable secured to a wall surface 41 with available fastening means such as screws, nails, adhesive pads and the like.

The switching apparatus of the present invention as shown in FIGS. 1–3 of the drawings is mounted for use by attaching screw eyes 13 and 14 to wall surface 16 by screwing the threaded extensions 18 and 19 into the wall. While the upper eye 13 is positioned substantially directly above or below toggle 22 of switch 17, the lower eye 14 may be located either directly below or above the first eye 13 or offset therefrom to the left or right of a vertical position. The location of the respective eyes will depend upon the desired position of the enlarged portion 27 which must be readily available and free from obstacles so that the apparatus of the invention can be used conveniently.

Next the rod member 12 is inserted through the eyes 13 and 14. The order of insertion will depend upon the relative size of the eyes and the forked end 24 and the enlarged portion 27. After inserting the rod member 12 through the eyes 13 and 14, the connecting means including sleeve 21 are attached to the forked end 24 of the rod member with pins 25 and the sleeve slipped over the toggle 22 of switch 17. The switch actuating apparatus then can be used to operate switch 17 simply by pushing or pulling on the enlarged spherical portion 27.

The switch actuating apparatus of the invention shown in FIG. 4 is mounted for use in a similar manner with the bracket extensions 39 and 40 of the eyes 37 and 38 being attached to the wall surface 41. The caps 31 and 32 are slipped over the toggle 33 and the end of rod member 34 to complete the assembly. The switch is operated by pushing or pulling on ring member 30 attached to the free end of rod member 34.

The above description and the accompanying drawings show that the present invention provides a novel switch actuating apparatus which permits toggle switches to be operated from a point away from the switch. The toggle switch actuating apparatus of the invention enables small children to operate switches without assistance from others. Also, the switch actuating apparatus allows furniture and appliances to be placed in desired locations without restrictions or limitations of their placement because of the position of switches.

Furthermore, the toggle switch actuating apparatus of the present invention is convenient to use. The apparatus is easily mounted on fixed surfaces such as walls with a minimum of instruction and without special tools or skills on the part of the installer. The switch actuating apparatus of the invention is simple in design and can be fabricated from commercially available materials and components. Conventional metal working techniques may be employed in the fabrication of the apparatus. Moreover, the switch actuating apparatus of the invention is relatively inexpensive to produce.

It will be apparent that various modifications can be made in the particular switch actuating apparatus described in detail above and shown in the drawings within the scope of the invention. For example, the size and configuration of the components may be changed to meet specific requirements. Also, the design of the carriage means may be different provided operation and movement of the rod member is not adversely affected. In addition, the connecting means may be constructed differently to provide freedom of operation in cramped or unusual situations. Therefore, the scope of the invention is to be limited only by the following claims.

What is claimed is:

1. Apparatus for actuating an electrical toggle switch including a rigid rod member, carriage means disposed along the length of said rod member supporting said rod member for movement with respect thereto, fastening means associated with said carriage means for securing said carriage means to a fixed surface adjacent to an electrical toggle switch, connecting means on the end of said rod member adjacent to said switch, said connecting means including a cap-like rod-engaging portion and a cap-like toggle-engaging portion extending in different directions, a pivotable section connecting said rod-engaging portion with said toggle-engaging portion, and an enlarged portion on the free end of said rod member remote from said toggle switch.

2. Apparatus for actuating an electrical toggle switch according to claim 1 wherein said carriage means includes a plurality of rod-encircling members.

3. Apparatus for actuating an electrical toggle switch according to claim 2 wherein said rod-encircling members are screw eyes.

4. Apparatus for actuating an electrical toggle switch according to claim 1 wherein said pivotable section includes hinge means.

5. Apparatus for actuating an electrical toggle switch according to claim 1 wherein said toggle-engaging portion, said rod-engaging portion and said pivotable section are molded of a plastic material as an integral unit.

6. Apparatus for actuating an electrical toggle switch according to claim 1 wherein said enlarged portion on the free end of said rod member includes a ring member.

* * * * *